US008876617B2

(12) United States Patent
Robbins et al.

(10) Patent No.: US 8,876,617 B2
(45) Date of Patent: Nov. 4, 2014

(54) CHILD SWING WITH VERSATILE SEAT ASSEMBLY

(75) Inventors: Chad Robbins, Atlanta, GA (US); Brandon Seth Cross, Atlanta, GA (US)

(73) Assignee: Graco Children's Products Inc., Atlanta, GA (US)

( * ) Notice: Subject to any disclaimer, the term of this patent is extended or adjusted under 35 U.S.C. 154(b) by 145 days.

(21) Appl. No.: 13/424,092

(22) Filed: Mar. 19, 2012

(65) Prior Publication Data

US 2013/0244802 A1 Sep. 19, 2013

(51) Int. Cl.
*A63G 9/16* (2006.01)
*A63G 9/00* (2006.01)

(52) U.S. Cl.
USPC ..... 472/119; 472/118

(58) Field of Classification Search
USPC ..... 472/118–125; 297/273, 274, 284; 5/101, 108, 109
See application file for complete search history.

(56) References Cited

U.S. PATENT DOCUMENTS

| | | | | |
|---|---|---|---|---|
| 5,562,548 | A | 10/1996 | Pinch et al. | |
| 5,803,817 | A | 9/1998 | Stern | |
| D412,067 | S | 7/1999 | Wu | |
| D461,062 | S | 8/2002 | Wu | |
| 6,464,594 | B1 * | 10/2002 | Canna et al. | 472/119 |
| 7,252,594 | B2 * | 8/2007 | Armbruster et al. | 472/119 |
| 7,789,762 | B2 * | 9/2010 | Greger et al. | 472/119 |
| 8,029,377 | B2 * | 10/2011 | Velderman et al. | 472/119 |
| D660,026 | S | 5/2012 | Shi | |
| 8,439,765 | B2 | 5/2013 | Barron et al. | |
| 2002/0052245 | A1 | 5/2002 | Flannery et al. | |
| 2004/0198514 | A1 | 10/2004 | Armbruster et al. | |
| 2005/0143181 | A1 | 6/2005 | Armbruster et al. | |
| 2006/0128486 | A1 | 6/2006 | Tuckey | |
| 2006/0252566 | A1 | 11/2006 | Gibree | |
| 2009/0033133 | A1 | 2/2009 | Barron et al. | |
| 2012/0178544 | A1 * | 7/2012 | Horst et al. | 472/118 |

OTHER PUBLICATIONS

Fisher-Price Swing N Rocker V3394/W0386 Instruction Manual; 24 pages; (2010).
Fisher-Price Cradle and Swing P0097 Instruction Manual; 24 pages; (2008).

* cited by examiner

*Primary Examiner* — Kien Nguyen
(74) *Attorney, Agent, or Firm* — Lempia Summerfield Katz LLC

(57) ABSTRACT

A child swing has a frame with a base, a support extending up from the base, a hub carried by the support above the base, and a seat assembly having a swing arm with a seat carried at a lower end. The seat assembly moves in a swinging direction. The seat assembly is configured to be selectively removable from and connectable to the hub. The orientation of the seat assembly relative to the swinging direction is also selectively adjustable between a forward facing orientation and a side facing orientation.

20 Claims, 9 Drawing Sheets

CHILD SWING WITH VERSATILE SEAT ASSEMBLY

BACKGROUND

1. Field of the Disclosure

The present disclosure is generally directed to child swings, and more particularly to a child swing with a versatile seat assembly 2. Description of Related Art Infant swings or child swings are known in the art for soothing and entertaining very young children and infants. These types of swings typically include a frame and a seat supported above a surface by a swing arm coupled to the frame. Many of these types of swing products are motorized so that the seat and swing arm can move continuously without manual assistance from either the seat occupant or the caregiver during use.

Certain types of infant and child swings are constructed to allow the seat to be reoriented or repositioned during use. The seat occupant of the swing can thus either face sideways relative to the swinging direction so as to swing side to side or forward or rearward relative to the swinging direction so as to swing fore and aft. Some swings allow for the seat assembly, including the swing arm, to be reoriented to change the seat facing direction. Other swings allow for only the seat to pivot or rotate on the seat assembly or swing arm, which otherwise remains in the same orientation regardless of seat position. U.S. Pat. Nos. 5,562,548 and 5,803,817 disclose two examples of such swings.

There are several known infant or child swings that provide these and other various features and functions on the swing product. The Cradle and Swing produced by Fisher-Price has a child seat that can be reoriented relative to the swinging direction of the seat assembly. The Swing N Rocker, also produced by Fisher-Price, has a child seat that cannot rotate or be reoriented, but the seat assembly can be removed from the swing frame and used as a rocker.

SUMMARY

The disclosed child swings combine a number of different features and functions of prior known swings into one versatile swing product. In one example according to the teachings of the present invention, a child swing has a frame with a base, a support extending up from the base, and a hub carried by the support above the base. The child swing has a seat assembly with a swing arm, a seat carried at a lower end of the swing arm, and a hanger at an upper end of the swing arm and coupled to the hub. The hanger is configured to be selectively removable from and connectable to the hub. The seat assembly is usable as a child seat when removed from the frame. The seat moves in a swinging direction and the orientation of the seat relative to the swinging direction is selectively adjustable between at least one forward facing direction and a side facing direction.

The seat assembly can include a seat frame configured to enable a rocking function, a bouncer function, or both, to the seat when the seat frame rests on a support surface.

In one example, a seat frame of the seat assembly can include a pair of spaced apart curved legs each defining a rocker surface. The rocker surfaces can be configured to support the seat above a support surface and allow the seat to rock thereon.

In one example, a seat frame of the seat assembly can have a curved resilient structure configured to support the seat above a support surface. The curved resilient structure can enable the seat to bounce relative to the support surface.

In one example, a seat frame of the seat assembly can have a pair of spaced apart legs that are curved, resilient, and each defining a rocker surface. The legs can support the seat above a support surface and can be configured to allow the seat to rock and/or to bounce relative to the support surface.

In one example, the hub can have a pair of bosses protruding from opposed sides thereof. The hanger can be configured to mount to and hang the seat assembly from the bosses.

In one example, the hanger can have a latch with an actuator actuable to selectively release the hanger from the hub.

In one example, the hanger can have a U-shaped latch with an actuator on a transverse leg between a pair of latch legs. The latch can be biased to a latched position and the actuator can be actuable to move the latch to a released position.

In one example, the hub can have a pair of bosses protruding from opposed sides thereof. The hanger can have a pair of upwardly open pockets positioned to respectively catch on the bosses to hang the seat assembly from the hub.

In one example, the hanger can have a latch with an actuator and a pair of latch legs. The latch can be biased to a latched position with each latch leg engaged with a respective boss on the hub. The actuator can be actuable to move the latch legs to a released position disengaged from the bosses.

In one example, the hanger can have a handle that can be gripped to lift the seat assembly from the hub and to carry the seat assembly.

In one example, the hanger can have a handle to lift and carry the seat assembly. The handle can have an actuator that is actuable to release a latch that secures the hanger to the hub.

In one example, the hub can define a swing axis about which the swing arm pivots. The swing axis can be oriented to be aligned with the support so that the seat moves in a swinging direction tangent to the support.

In one example according to the teachings of the present invention, a child swing can have a frame with a base, a support extending up from the base, and a hub supported by the support above the base. The child swing has a seat assembly with a swing arm including an upper end coupled to the hub and a seat carried by a lower end of the swing arm. The hub and seat assembly are configured so that the seat moves in a swinging direction. The orientation of the seat relative to the swinging direction is adjustable among a plurality of different seat facing orientations including at least one swinging direction orientation and a side facing orientation. The seat assembly is detachable from and connectable to the hub and is usable as a child seat separate from the frame.

The seat assembly can include a seat frame configured to enable a rocking function, a bouncer function, or both, to the seat when the seat frame rests on a support surface.

In one example, a seat frame of the seat assembly can include a pair of spaced apart curved legs each defining a rocker surface. The rocker surfaces can be configured to support the seat above a support surface and allow the seat to rock thereon.

In one example, a seat frame of the seat assembly can have a curved resilient structure configured to support the seat above a support surface. The curved resilient structure can enable the seat to bounce relative to the support surface.

In one example, a seat frame of the seat assembly can have a pair of spaced apart legs that are curved, resilient, and each defining a rocker surface. The legs can support the seat above a support surface and can be configured to allow the seat to rock and/or to bounce relative to the support surface.

In one example, the hub can have a rotatable part that can be rotated about a generally vertical axis, whereby the seat assembly and rotatable part can rotate in concert when the seat assembly is reoriented.

In one example, the hub can have a rotatable part concentrically connected to a non-rotatable part. The seat assembly can be connected to the rotatable part and the rotatable part can have a lock mechanism configured to releasably lock the seat assembly in any selected one of the plurality of seat facing orientations.

In one example, the hub can have a rotatable part with a release element connected to a lock mechanism biased to a locked position preventing rotation of the rotatable part. The seat assembly can be connected to the rotatable part. The lock mechanism can be movable to an unlocked position permitting rotation of the rotatable part.

In one example, the hub can have a rotatable part connected to the seat assembly and rotatable about a generally vertical axis. The rotatable part can have a lock mechanism with a protrusion configured to seat in any selected one of a plurality of notches in the hub. Each notch can coincide with one of the plurality of seat facing orientations. In one example, the protrusion can be coupled to a push button release element that projects from the rotatable part of the hub.

In one example, the hub can define a swing axis about which the swing arm pivots. The swing axis can be oriented aligned with the support so that a plane of the swinging direction is generally perpendicular to an arm of the support.

In one example, the plurality of seat facing orientations can include an opposite swinging direction orientation that is oriented 180° from the one swinging direction orientation and wherein the side facing orientation faces away from the support.

In one example, the plurality of seat facing orientations can include the side facing orientation with the seat facing away from the support and can includes the one swinging direction orientation oriented 90° in one direction from the side facing orientation and an opposite swinging direction orientation oriented 90° in the opposite direction from the side facing direction.

BRIEF DESCRIPTION OF THE DRAWINGS

Objects, features, and advantages of the present invention will become apparent upon reading the following description in conjunction with the drawing figures, in which.

DETAILED DESCRIPTION OF THE DISCLOSURE

The disclosed child swing examples solve or improve upon one or more of the above-noted and/or other problems and disadvantages with prior known child swings, infant swings, and the like. In one example, the disclosed child swing has a seat assembly and a hub construction that permits the seat assembly to be rotated in order to reorient the seat relative to the swinging direction of the seat assembly. In one example, the disclosed child swing has a seat assembly that can be removed from the swing frame and used separately or independent of the swing frame as a child seat or infant seat. In the illustrated example, the child swing has a seat assembly with both of these features and functions. The child seat can be reoriented to different seat facing orientations relative to the swing frame. The seat assembly can also be removed or detached from the swing frame. In one example, the seat assembly of the disclosed child swing can be removed or detached from the swing frame whereby the seat can be utilized as a rocker, a bouncer, or both. All of these features are provided in one child swing having a relatively simple yet robust and versatile construction. These and other objects, features, and advantages of the present invention will become apparent to those having ordinary skill in the art upon reading this disclosure.

Figure 1:
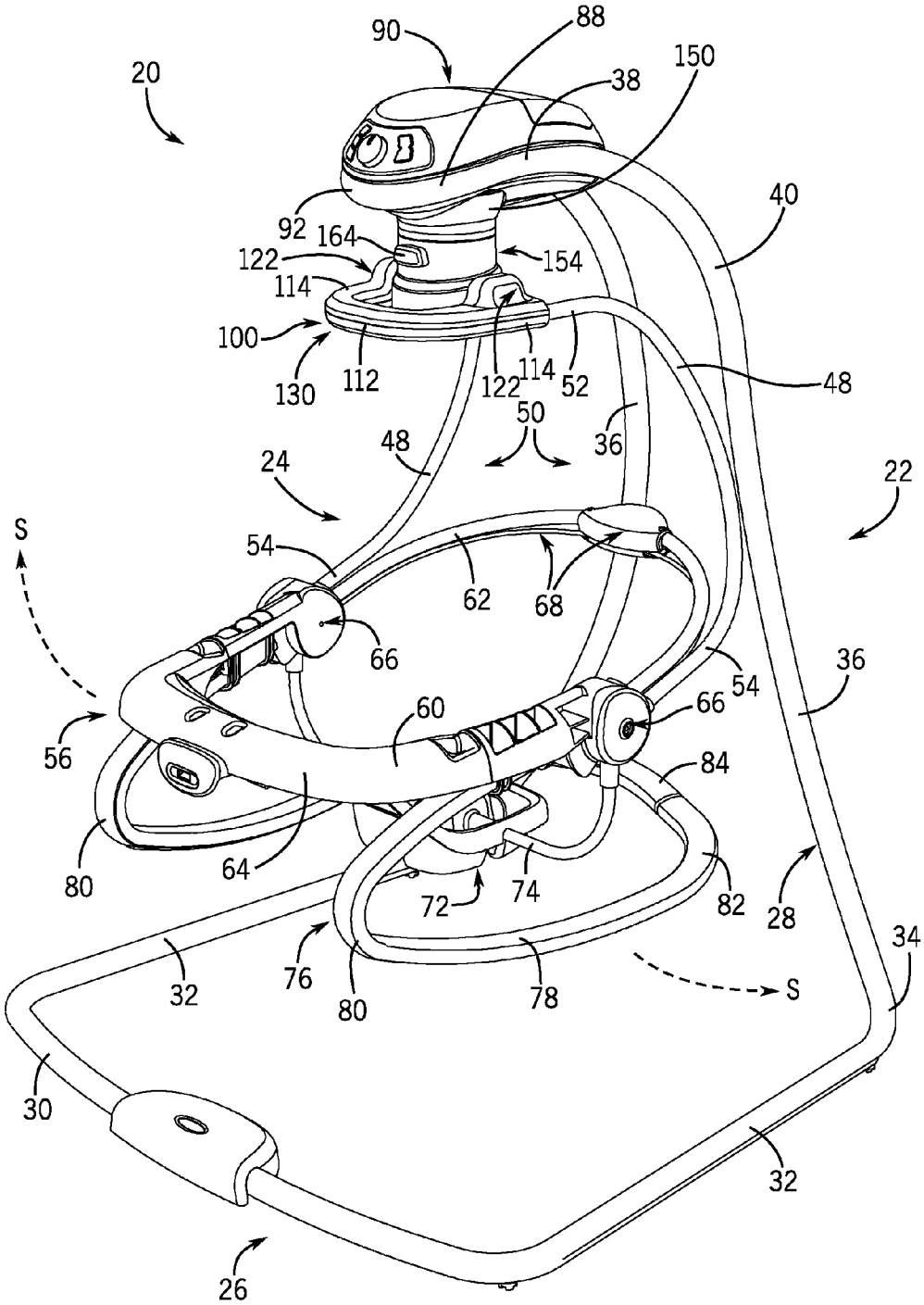
FIG. 1 shows a perspective view of one example of a child swing constructed in accordance with the teachings of the present invention and with the seat assembly in a first optionally selectable seat facing orientation.

Turning now to the drawings, FIG. 1 shows one example of a child swing 20 constructed in accordance with the teachings of the present invention. In general, the child swing 20 has a swing frame 22 and a seat assembly 24 suspended from the swing frame. In the disclosed example, the seat assembly 24 is configured to swing in a pendulum-like manner within a swing plane in a reciprocating, swinging direction indicated by the arrows S. For reference herein, the child swing 20 is constructed so that the seat assembly 24 swings in a swinging direction that is side to side relative to the swing frame 22. In the majority of swings of this type, the seat assembly would swing fore and aft, not side to side. As will become evident to those having ordinary skill in the art upon reading this disclosure, the child swing 20 can be constructed so that the seat assembly 24 swings in a fore and aft swinging direction instead of the side to side swinging direction, if desired.

In a disclosed example, the swing frame 22 generally has a base 26 configured to rest on the support surface. The swing frame 22 also generally has an upstanding support 28 that extends upward from the base 26. The base 26 in this example has a front bar 30 extending between and interconnecting two side bars 32. The front bar 30 is positioned at a front of the child swing 20 in this example. The term front is used herein merely for reference and is not intended to limit in any way the specific position or particular orientation of any components of the child swing. Likewise, the terms side, back, rear, and the like are also utilized herein for reference only and are not intended to limit the position or orientation of any portion of the child swing 20.

In the disclosed example, the rear ends 34 of the side bars 32 curve upward and continue into the support 28. Specifically, the support 28 in this example has upstanding leg sections 36 connected to the rear ends 34 of the base side bars 32. The support 28 also has forward extending arm sections 38 extending forward from upper ends 40 of the respective leg sections. The support 28 has two of the leg sections 36, one continuing from each of the side bars 32. Likewise, the support 28 has two of the arm section 38 each continuing from one of the leg sections 36. In this example, the leg sections 36 extends generally vertically upward and are tilted forward slightly over the base 26. The upper ends 40 of the leg sections 36 generally curve upward and forward and transition into the arm sections 38. The arm sections 38 are generally horizontal and positioned over the base in this example to provide a swing support arm from which the seat assembly 24 is suspended.

The swing frame 22 and the various support leg and arm sections can be formed of any suitable material and take on many forms or configurations and yet function as intended. In the disclosed example, the leg sections 36 and arm sections 38 of the swing frame 22 can be constructed of metal tubes that telescopically assemble from multiple tube segments, as is known in the art. The shape and configuration of the base 26 and support 28 can also vary from the example shown and described herein. The side bars 32 are spaced relatively widely apart so as to provide a stable base for the child swing 20. The support leg sections 36 are angled toward one another and become closer together moving upward from the base 26 to the support arm sections 38. However, different shapes and configurations are certainly within the spirit and scope of the present invention.

The seat assembly 24 in the disclosed example has a swing arm 50 with two swing arm segments 48, each with an upper end 52 and a lower end 54. The lower end of each swing arm segment 48 is coupled to the seat 56 so that the seat that is supported by the swing arm 50 above the base. The swing arm segments 48 in this example are generally C-shaped so that the lower ends 54 can connect to the seat 56. The majority of the swing arm segments 48 are spaced sufficiently rearward of the seat 56 so as not to interfere with a seat occupant during use. Likewise, the upper ends 52 are positioned sufficiently above the seat 56 so as to also not interfere with the seat occupant during use.

In the disclosed example, the seat 56 has a generally oval seat frame 60 with the seat back section 62 and a front section or seat bottom section 64. In the disclosed example, the seat frame 60 would support a fabric material or soft goods, which are not shown herein so that the structure of the child swing 20 is more readily visible in the drawing figures. Also, the configuration and construction of the seat frame 60 is not a critical part of the present disclosure and thus can vary considerably from that shown and described herein. In general, the seat back section 62 and bottom section 64 are pivotally connected to one another at side joints 66 in this example. The seat back section 62 has a recline mechanism 68 with an actuator 70. The actuator 70 can be manipulated to release the seat back section 62 to adjust the incline or recline of the seat back section relative to the seat bottom section 64.

In this example, the seat frame 60 also includes an undercarriage 72 defining a supportive seat bottom for a seat occupant during use. The undercarriage 72 is connected to the seat frame 60 by a transverse bar that helps maintain the structural integrity of the seat frame. In this example, the undercarriage 72 is connected only to the seat bottom section 64 allowing the seat back section 62 to pivotally raise and lower freely to adjust the recline.

Figure 2:
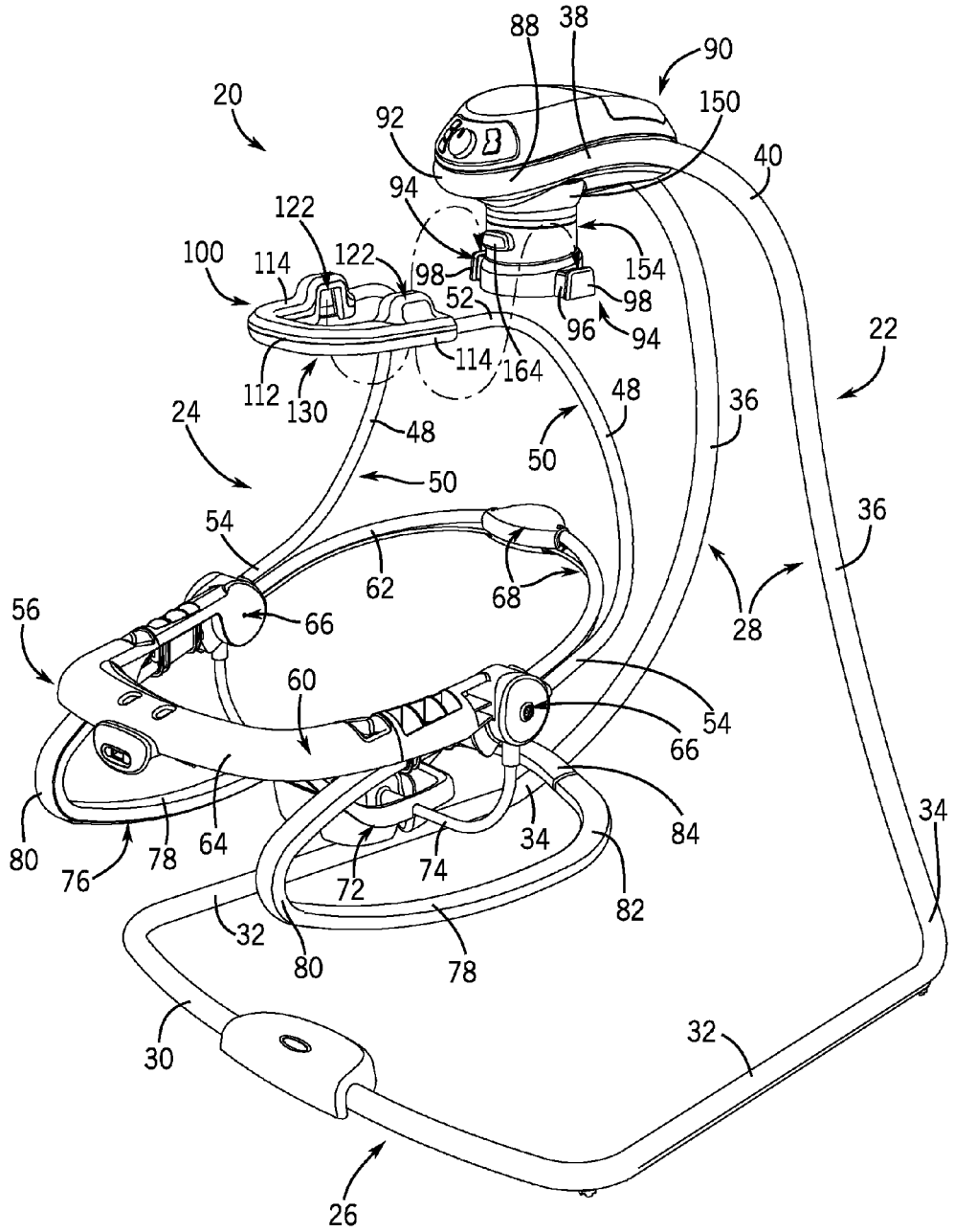
FIG. 2 shows the child swing shown in FIG. 1 but with the seat assembly disengaged or detached from the swing frame.

In one aspect of the invention, the seat assembly 24 is detachable from the swing frame 22 as shown in FIG. 2. The seat assembly 24, and thus the seat 56, can be utilized as a child seat separate from the swing frame 22 in the disclosed example. The seat 56 in this example has a multi-function seat base 76. The seat base 76 has a pair of seat legs 78 that are laterally spaced apart from one another under the seat frame 60. The seat legs 78 are generally upwardly curved and yet oriented relatively horizontally and spaced below the seat frame 60. Front ends 80 of the seat legs 78 curve upward and then rearward. The front ends 80 are connected to the seat bottom section 64 of the seat frame 60. Rear ends 82 of the seat legs 78 are joined only to one another by a transverse leg 84.

The transverse leg 84 and the rear ends 82 of the seat legs 78 are connected only to one another and not otherwise to the seat frame 60 and are also spaced from the undercarriage 72. The curvature of the seat legs 78 define rocker surfaces on which the seat assembly 26 can rock when the seat legs are rested on a support surface. The seat frame 60 can also be constructed from resilient molded plastic or other suitable carbon-based materials or can be fabricated from resilient bent wire. The curved front ends 80 of the seat legs 78 and the free rear ends 82 and transverse leg 84 can thus create a resilient spring effect to provide a bouncy seat or bouncer function. Thus, in the disclosed example, the seat assembly 24, when detached or removed from the seat frame 22, can be separately used as an infant rocker, bouncer, or seat as needed. The seat base 76 can include only the rocker function, the bouncer function, or both as disclosed herein.

Figure 3:
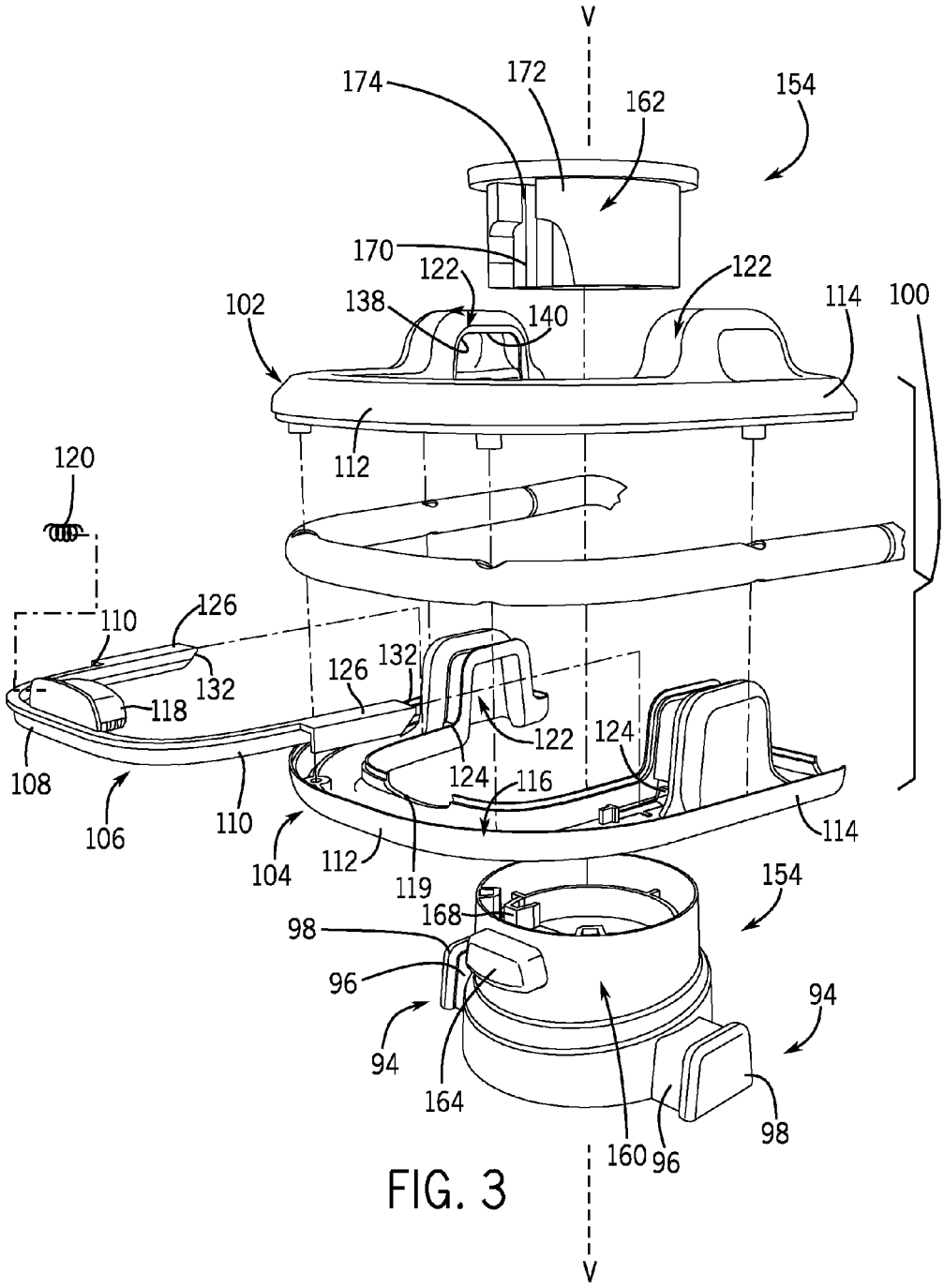
FIG. 3 shows an exploded view of a portion of a hub of the child swing shown in FIGS. 1 and 2.

With reference to FIGS. 2 and 3, the child swing 20 has a swing hub or hub 90 mounted to and carried by forward ends 88 of the support arm sections 38 of the support 28. As shown herein, the forward ends 88 are joined to one another by a curved frame segment 92. The hub 90 is mounted to the curved frame segment and forward ends 88 and is thus also positioned over the base 26 in this example. As is known in the art, these types of child swings can be motorized. Thus, the hub 90 can include a motor (not shown) housed within the hub to drive the seat assembly 24 through a reciprocating swing arc in the swinging direction S. Alternatively, the hub 90 can house a spring drive mechanism that can mechanically assist the seat assembly 24 in maintaining a swinging movement to at least temporarily overcome gravity as is also known in the art. As shown herein, the hub 90 can include a number of controls 94 thereon for operating the motor. The hub can also include electronics to provide optional swing characteristics such as speed, stroke, a swing timer, audio entertainment, and the like. The controls 94 can be configured to operate the motor and any other electronic features of the child swing 20 as desired.

As shown in FIGS. 2 and 3, the hub 90 has a pair of bosses 94 that protrude from opposite sides of part of the hub. Each of the bosses 94 has a stem 96 connected to the hub 90 and the larger sized head 98 on the end of the stem. The seat assembly 24 has a hanger 100 connected to the arm segments 48 of the swing arm 50. In this example, the hanger 100 is a U-shaped element having an upper cover 102 and a lower cover 104. The curved front segment 92 of the swing arm segments 48 is sandwiched between the upper and lower covers 102, 104. The hanger also houses a latch mechanism that can latch and release the seat assembly 24 relative to the swing frame 22.

The latch mechanism includes a U-shaped latch 106 also captured between the upper and lower covers of the hanger 100. The latch 106 has a transverse leg 108 that extends laterally between a spaced apart pair of longitudinal latch legs 110. The upper and lower covers 102, 104 of the hanger 100 also form a transverse element 112 extending between a pair of spaced apart longitudinal elements 114 when the covers are assembled. The latch 106 is seated in a cavity 116 defined between the upper and lower covers. The latch 106 can translate longitudinally within the cavity 116 such that the latch legs 110 can move within the longitudinal elements 114 of the hanger 100.

An actuator 118 is provided on the transverse leg 108 of the latch 106. The actuator faces the U-shaped interior of the hanger 100. The actuator 118 is exposed and projects outward through a hole 119 defined by the joined upper and lower covers 102, 104. A spring 120 biases the latch 106 rearward to a latched position, in which the actuator 118 protrudes from the hanger 100. When assembled, the upper and lower covers 102, 104 define a pair of pockets 122 that are open on a downward facing side. Each pocket 122 is positioned on one of the longitudinal elements 114 on the hanger 100 and is positioned to coincide and engage with a respective one of the bosses 94. A latch opening 124 is formed through a front side of each pocket and into the pocket interior. Each latch leg 110 terminates at a latch finger 126 that is aligned with one of the latch openings 124 in a respective pocket 122. In the latched position, the latch fingers 126 protrude into the interior of the corresponding pockets 122 through the latch openings 124.

Figure 4:
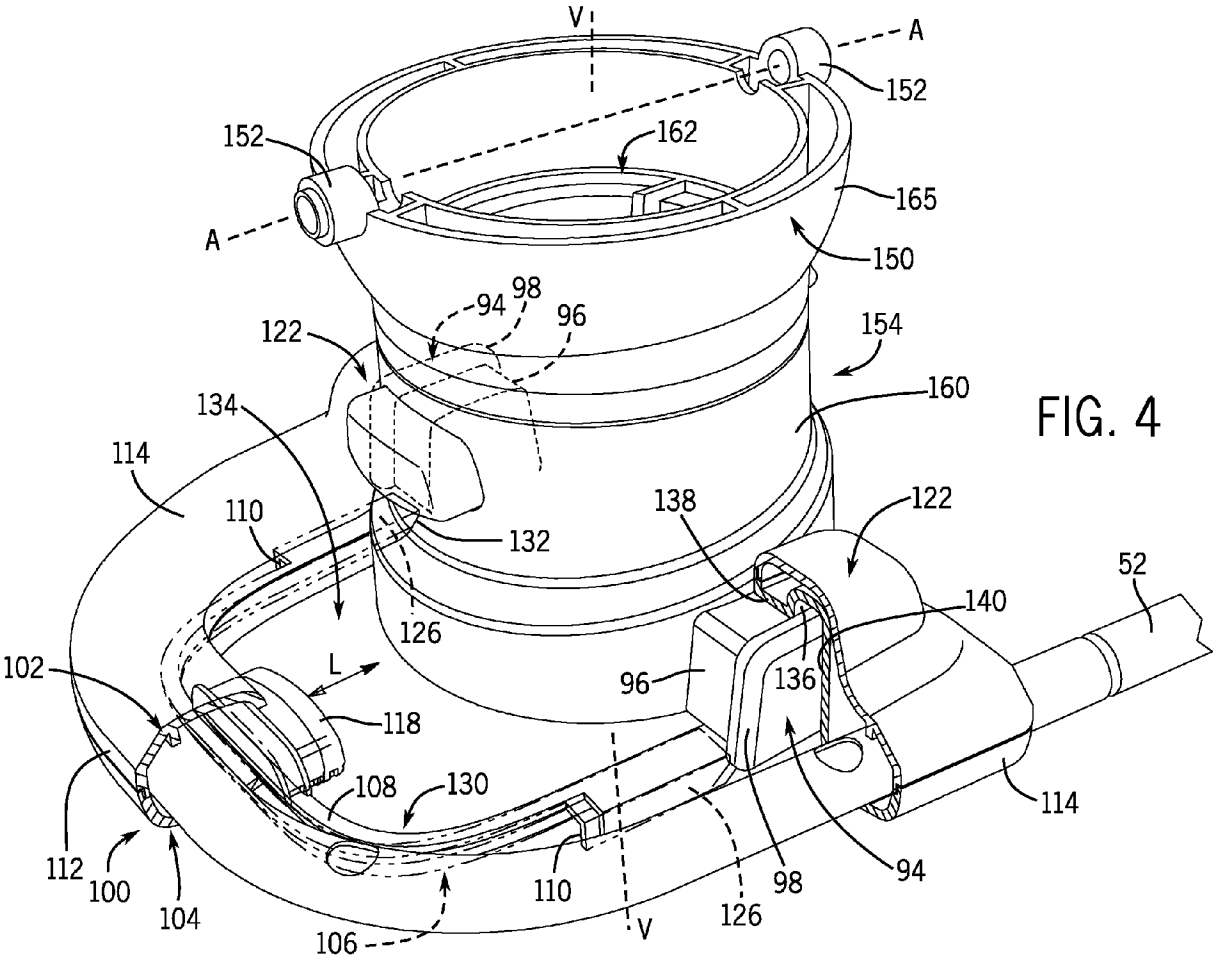
FIG. 4 shows an assembled top perspective and partial cutaway view of the hub portion shown in FIG. 3.

With reference to FIGS. 2 and 4, a handle 130 is formed by the transverse element 112 on the hanger 100. The structure of the hub 90 and the hanger 100 are such that a space is provided between the hub and handle 130 so that a user can easily grip the handle when the seat assembly 24 is mounted to the swing frame 22. The actuator 118 is provided on the handle 130 and can be squeezed inward toward the handle from the latched position to a released position against the bias of the latch spring 120. When the actuator 118 is released, the spring 120 will return the latch 106 back to the latched position. The latch movement and actuator movement is depicted in FIG. 4 by the arrows L. The free ends of the latch fingers 126 at an angled, ramped, or wedge shaped tip 132 thereon. The seat assembly 24 can be gripped by the handle 130 in order to lift and carry the seat assembly 24. The handle 130 can be gripped to also attach and detach the seat assembly 24 from the swing frame 22.

Figure 5:
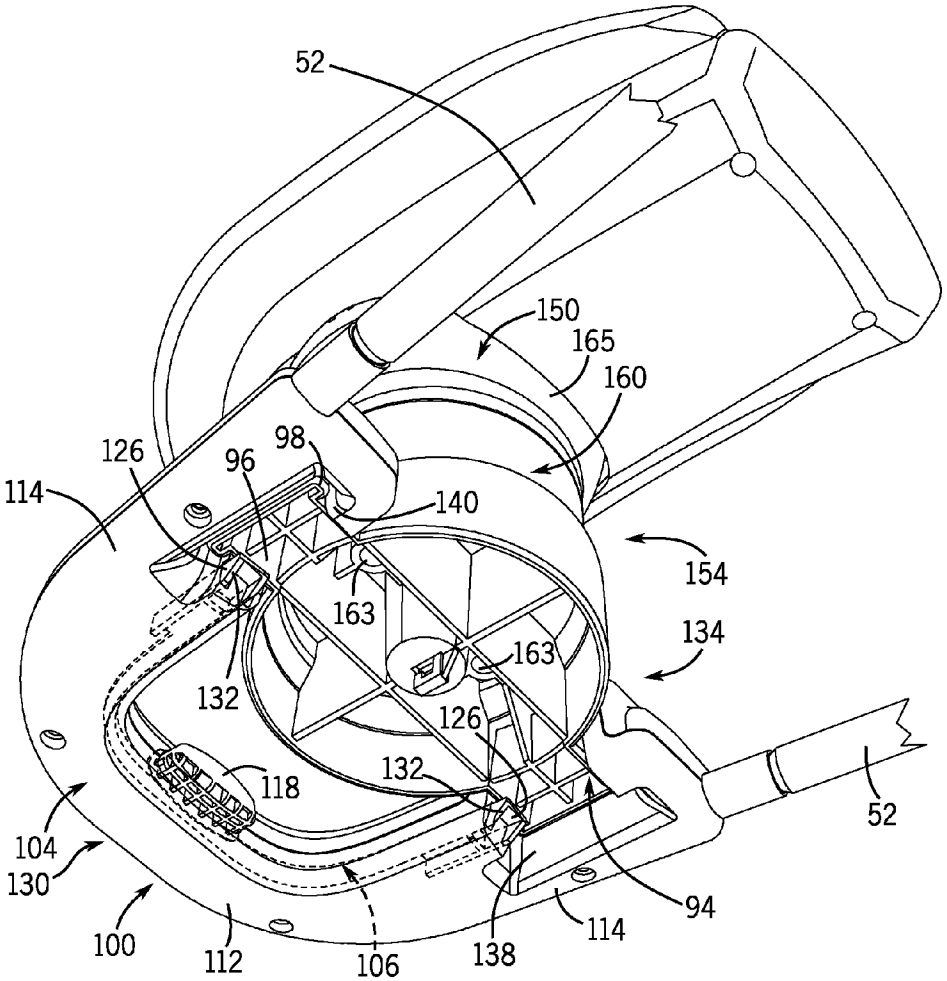
FIG. 5 shows a bottom perspective view of the hub portion shown in FIG. 4.

The U-shaped hanger 100 defines a rearward facing opening or gap 134 at the top of the seat assembly between the longitudinal elements 114. The user can lift the seat assembly 24 by the handle 130 and position the pockets 122 above and over the bosses 94 with the hub 90 positioned in the gap 134. The seat assembly 24 can then be lowered so that the pockets 122 drop onto the corresponding bosses 94. If the actuator 118 is squeezed to the released position, the pockets will simply drop onto the bosses and engage them. If the actuator 118 is not squeezed, the wedge shaped tips 132 on the latch fingers 126 can automatically drive the latch fingers 126 toward the released position, allowing the bosses to clear the latch fingers and enter the pockets. When engaged, the latch 106 is biased to the latched position and which will position the latch fingers 126 beneath the bosses 94, capturing and securing them within the pockets 122 as shown in FIG. 5.

Each of the pockets 122 can have a groove 136, as best illustrated in FIG. 4, configured to coincide with the size and position of the head 98 on the respective stem 96. The combination of the grooves 136 and heads 98 can assist in properly positioning and guiding the pockets onto the bosses in order to attach the seat assembly 24 to the swing frame 22. Each groove 136 can be defined by and between a pocket wall 138 and a lip 140. The lips can be sized to generally coincide with the size of the stems 96 on the bosses and thus are smaller than the groove size.

In order to detach the seat assembly 24 from the swing frame 22, a user need only grip the handle 130 and squeeze the actuator 118. This moves the latch fingers 126 to the released position, withdrawing them from the latch openings 124. This disengages the latch 106 from the pockets 122. Each pocket 122 can then be raised upward to clear the corresponding boss 94. The seat assembly 24 can be lifted using the handle 130 as represented in FIG. 2.

In the foregoing description, the child swing 20 is described as having a seat assembly 24 that can be attached to and detached from the swing frame 22. In this example, the entire seat assembly, including the support 28 and seat 56, is detachable from the seat frame 22. The detachment mechanism and method and the reattachment mechanism and method, including the latch mechanism, are relatively simple in construction, require few separate moving parts, and are relatively easy to operate. As will be evident to those having ordinary skill in the art, the components, configuration, contour, and the like of the hanger 100, latch 106, bosses 94, and pockets 122 can vary within the spirit and scope of the present invention. In one example, the bosses 94 and pockets 122 can be reversed whereby bosses are provided on the seat assembly and upward facing pockets are provided on the hub 90. Likewise, the bosses and pockets in this example have a generally square or rectangular configuration. In other examples, these components can be circular, oval, round, triangular, spherical, or the like. Component details of the latch mechanism can also vary. The latch 106 can be provided on an underside of the hanger 100 instead of sandwiched in a cavity between two hanger cover parts. The latch fingers 126 can be configured to lie beneath both the pockets and bosses, if desired.

In another aspect according to the teachings of the present invention, the seat assembly 24 and swing frame 22 are configured to permit the seat assembly to be reoriented relative to the swing frame and swinging direction S. As shown in FIGS. 1 and 4, the hub 90 has an upper cylinder or part 150. A pair of aligned, spaced apart axle sleeves 152 is positioned at the top of the part 150. The axle sleeves are configured to receive a pivot axle (not shown) for the child swing 20. The seat assembly 24 will pivot about a swing axis A defined by the axle sleeves 152. In this example, the pivot axis is oriented lengthwise relative to the swing frame 22 and thus extends from front to back as defined herein. Thus, as noted briefly above, the seat assembly 24 will swing in a side to side swinging direction depicted by the arrows S in FIG. 1. As a result, the seat 56, though forward facing relative to the seat frame 22 in the position shown in FIG. 1, will swing side to side from the viewpoint of the seat and a seat occupant. This is because the seat assembly 24 swings side to side on the swing frame 22 about the lengthwise pivot axis A.

Figure 6:
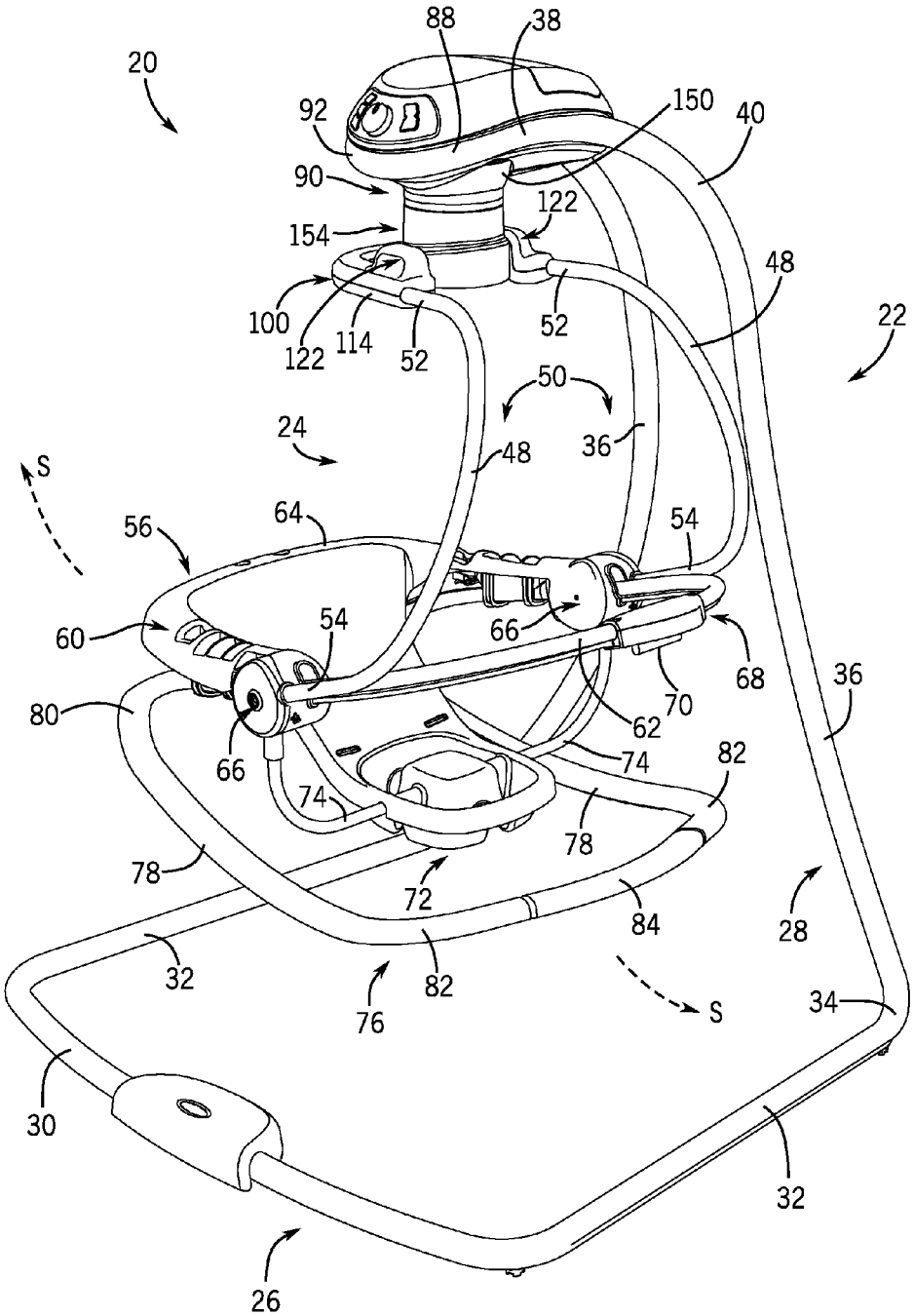
FIG. 6 shows a perspective view of the child swing shown in FIG. 1, but with the seat assembly in a second optionally selectable seat facing orientation.
Figure 7:
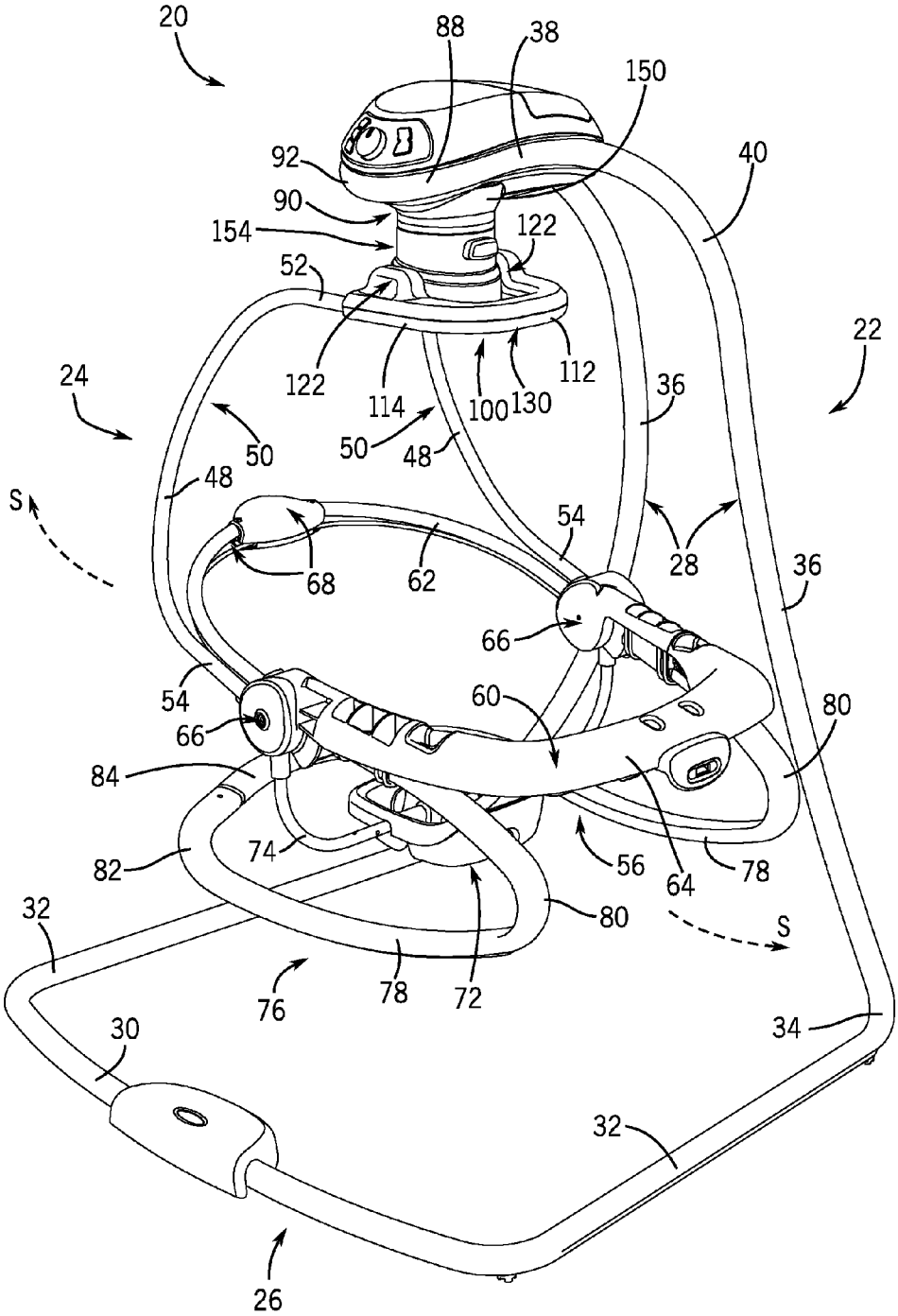
FIG. 7 shows a perspective view of the child swing shown in FIG. 1, but with the seat assembly in a third optionally selectable seat facing orientation.

As shown in FIGS. 6 and 7, the seat assembly 24 can be rotated about a generally vertical axis V from the side to side swinging seat facing orientation shown in FIG. 1. In one example, the seat assembly 24 can be rotated 90° to the right from the side to side seat facing orientation to a first forward seat facing orientation. Again, the seat 56 faces toward a side of the seat frame 22 in this orientation. However, because the swinging direction of the child swing 20 in this example is side to side, the occupant of the seat 56 will experience a front to back swinging motion when seating in the seat 56 in the seat orientation depicted in FIG. 6. Likewise, in another example, the seat assembly 24 can be rotated 90° to the left from the side to side seat facing orientation to a second forward seat facing orientation. The second forward seat facing orientation is 180° opposite the first forward seat facing orientation. However, the seat occupant will again experience a fore and aft swinging motion because the seat assembly 24 swings in a side to side swinging direction on the swing frame 22.

Figure 8:
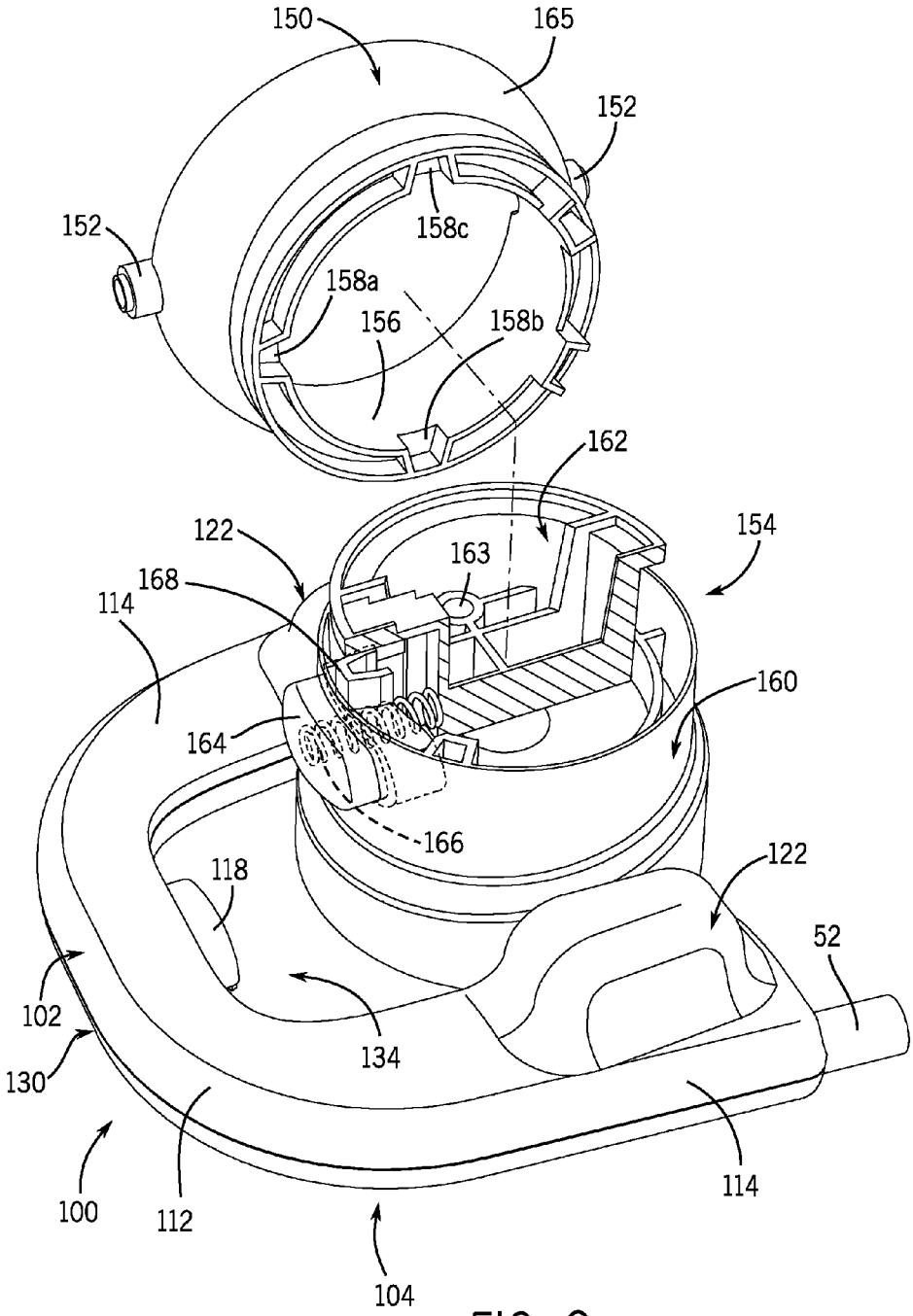
FIG. 8 shows a partial exploded and cross-section view of the hub portion shown in FIGS. 3-6.
Figure 9:
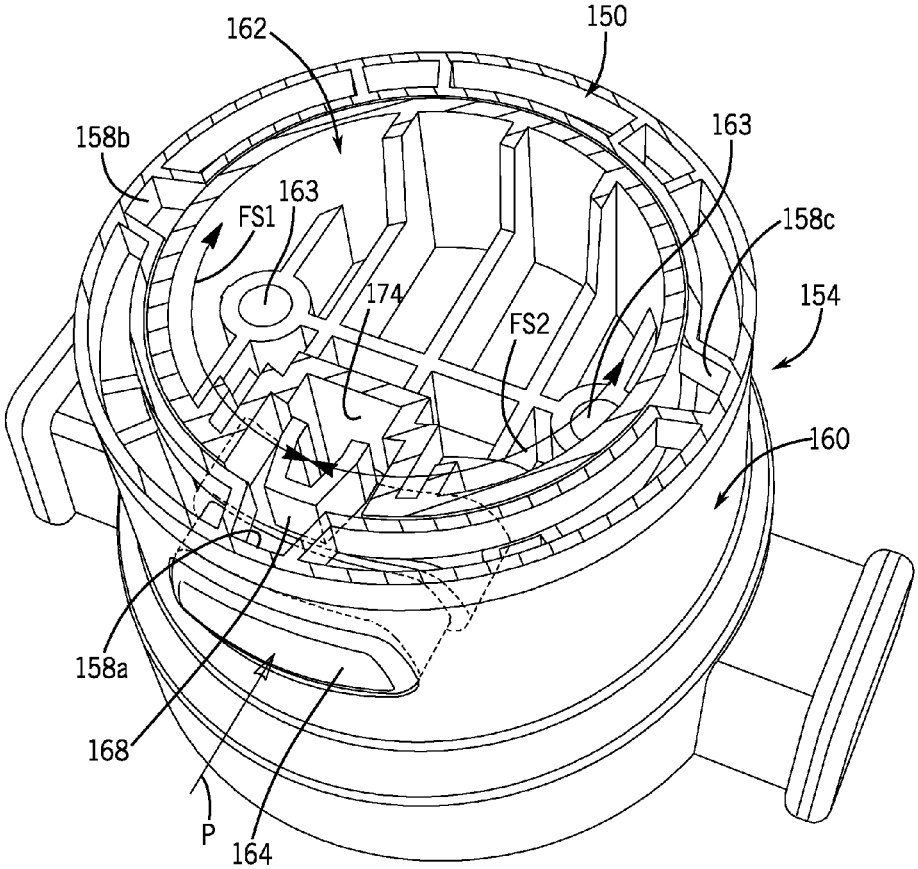
FIG. 9 shows a horizontal cross-section of the hub portion shown in FIG. 8.

With reference to FIGS. 3, 8, and 9, this seat orientation adjustment capability is provided by the construction of a cylinder portion of the hub 90 in this example. The upper cylinder or part 150 of the hub in this example can swing about a horizontal swing axis A as described above. However, the upper part 150 is non-rotatable about the vertical axis V of the hub. The hub 90 also has a lower part 154 that is a rotatable part of the hub about the vertical axis V. The rotatable part 154 can rotate relative to the non-rotatable part 150 in order to reorient the seat assembly 24 when it is attached to the hub 90. In this example, the bosses 94 are affixed to the rotatable part 154 of the hub, as described in further detail below. Thus, the bosses 94 will rotate about the vertical axis V along with the rotatable part 154 of the hub 90.

The cylinder portion of the hub 90 defines a lock mechanism that is utilized to lock the seat assembly 24 in a selected one of the aforementioned seat facing orientations of FIGS. 1, 6, and 7. The lock mechanism can be manipulated to release the seat assembly 24 and reposition or reorient the seat assembly among any one of the selectable seat facing orientations. In this example, an interior cylindrical surface 156 of the non-rotatable part 150 of the hub has three notches or seats 158*a*, 158*b*, and 158*c* formed therein. Each of these notches or seats 158*a-c* forms a part of the lock mechanism. A central one 158*a* of the notches or seats faces forward relative to the seat frame 22. The remaining two notches or seats 158*b* and 158*c* are positioned 180° opposite one another and each 90° from the central notch or seat. Each notch or seat 158*a-c* in this example defines one of the three seat facing orientations of the seat assembly 24 noted above.

In this example, the rotatable part 154 of the hub 90 has two components including an outer cylinder 160 and an inner cylinder 162. The cylinders 160, 162 are telescopically connected to one another and rotatably fixed to one another relative to the vertical axis V. The outer cylinder 160 is essentially a cover for this portion of the hub 90. The bosses 94 are mounted to the exterior surface of the outer cylinder 160 in this example. When assembled, the upper part 150 is sandwiched or captured vertically between the outer cylinder 160 and inner cylinder 162. The two cylinders 160, 162 are fastened together using nuts and bolts (not shown) received through holes 163 (see FIGS. 5, 8, and 9). The inner cylinder 162 is seated in a larger sized, spheroid section 165 of the upper part 150, as seen in FIG. 4, when assembled, as shown in FIG. 9. The upper part is shown exploded from the lower part 154 in FIG. 8, but would otherwise be captured between the two cylinders 160, 162 of the lower part. The upper part 150 is not shown in FIG. 3, but would also be captured between the two cylinders 160, 162, if assembled.

A release element 164 protrudes through an opening in the outer cylinder 160. In this example, the release element 164 is a push button that is biased by a spring 166 outward to a locked position as depicted in FIG. 8. A lock protrusion 168 is positioned above and connected to the release element 164. The lock protrusion 168 thus will move in concert with the release element 164 or push button in this example. When the button or release element 164 is pushed inward into the outer cylinder 160, the lock protrusion 168 will also move radially inward therewith. When the push button is released, the spring 166 will again fire the push button to the locked position.

The inner cylinder 162 has a recess 170 for the release element 164 in its outer surface 172. When assembled, the release element 164 is seated in the recess 170, rotationally interlocking the two cylinders. A slot 174 is positioned above the recess 170 in the outer surface 172 of the cylinder 162. The lock protrusion 168 seats in the slot 174. The depth of the recess 170 and slot 174 permit the radially inward movement of the release element 164 or push button and the lock protrusion 168 between the locked and unlocked positions.

When assembled, the release element 164 can be pressed inward in the direction of the arrow P as shown in FIG. 9 to the unlocked or released position depicted therein. This releases the lock protrusion 168 from one of the notches or seats 158. In this figure, the lock protrusion is shown released from the central notch or seat 158*a*, which corresponds to the side to side seat facing orientation relative to the swinging direction S of the seat assembly shown in FIG. 1. When the lock mechanism is in the released position, the rotatable hub part 154 can be rotated relative to the non-rotatable hub part 150. Thus, the release element 164 and the lock protrusion 168 can rotate relative to the stationary or fixed notches or seats 158*a-c*. The seat assembly 24 can be rotated to the right in the direction of the arrows SF1 to orient the seat 56 in the first forward seat facing orientation depicted in FIG. 6. The lock protrusion 168 will ride along the interior cylinder surface 156 until it aligns with the corresponding notch or seat 158*b*. Once so aligned, the spring 166 will fire the lock protrusion 168 into the appropriate notch or seat 158*b*. The seat assembly can optionally be rotated to the left in the direction of the arrows SF2 to orient the seat 56 in the second forward seat facing orientation depicted in FIG. 7. IN this orientation, the lock protrusion 168 will seat in the notch or seat 158*c*.

Thus, the seat assembly 24 in this example can be rotated relative to the vertical axis V and reoriented relative to the swinging direction S of the swing frame 22. The user need only depress the release element 164, i.e., the push button, and then rotate the seat assembly 24 to the desired orientation.

The reorientation and lock mechanisms and method are also relatively simple in construction, require few separate moving parts, and are relatively easy to operate. As will be evident to those having ordinary skill in the art, the components, configuration, contour, and the like of the hub 90 including the hub parts 150, 154, cylinders 160, 162, and lock mechanism can vary within the spirit and scope of the present invention. In one example, the lock protrusion 168 and the notches or seats 158*a-c* can be reversed as well. Likewise, the shape and configuration of the parts can also vary. The lock mechanism components and hub parts can take on different configurations and yet function as intended.

In the disclosed example, the child seat 20 includes a highly versatile seat construction. The seat assembly 24 can be reoriented among a plurality or multiple different seat facing orientations relative to the swinging direction S of the swing frame 22. The seat assembly 24 can also be entirely detached and removed from the swing frame 22, if and when desired. The seat assembly 24 is configured so that it can be easily carried by the handle 130 and the seat can be separately utilized as a child seat. The seat assembly 24 is also constructed to provide the seat 56 with a rocking function and a bouncer function. Thus, the disclosed child swing 20 and seat assembly 24 are highly versatile.

The design of the components that achieve the aforementioned features and functionality of the versatile seat construction are relatively simple and require relatively few parts. Operation of the lock mechanism to reorient the seat assembly is relatively easy and intuitive. The user need only depress a push button or actuate a release element and then rotate the seat assembly to the desired orientation. Operation of the latch mechanism to detach and reattach the seat assembly from the swing frame is also relatively easy and intuitive. The user need only grasp the handle 130 and depress the actuator 118 in order to free the seat assembly so it can be lifted from the seat frame 22 and detached. The seat assembly 24 can then be easily reattached to the swing frame 22 simply by gripping the handle 130, lifting the seat assembly, and dropping the pockets 122 on to the bosses 94. The user may optionally depress the actuator 118 when doing so or may rely on the ramp or wedge shape of the tips 132 on the latch fingers 126 in order for the latch mechanism to reengage the bosses.

Although certain child swings and features and components thereof have been described herein in accordance with the teachings of the present disclosure, the scope of coverage of this patent is not limited thereto. On the contrary, this patent covers all embodiments of the teachings of the disclosure that fairly fall within the scope of permissible equivalents.

What is claimed is:

1. A child swing comprising:

a frame having a base, a support extending up from the base, and a hub carried by the support above the base; and a seat assembly having a swing arm with a seat carried at a lower end and a hanger at an upper end coupled to the hub, wherein the hanger is configured to be selectively removable from and connectable to the hub and the seat assembly is usable as a child seat when removed from the frame, wherein the seat moves in a swinging direction and the orientation of the seat relative to the swinging direction can be selectively adjusted between a forward facing direction and a side facing direction, and wherein the hanger has a handle that can be gripped to lift the seat assembly from the hub and to carry the seat assembly.

2. A child swing according to claim 1, wherein the hanger has a latch with an actuator actuable to selectively release the hanger from the hub.

3. A child swing according to claim 2, wherein the latch is a U-shaped latch with the actuator on a transverse leg between a pair of latch legs, the latch biased to a latched position and the actuator actuable to move the latch to a released position.

4. A child swing according to claim 1, wherein the handle has an actuator that is actuable to release a latch that secures the hanger to the hub.

5. A child swing comprising:

a frame having a base, a support extending up from the base, and a hub carried by the support above the base; and a seat assembly having a swing arm with a seat carried at a lower end and a hanger at an upper end coupled to the hub, wherein the hanger is configured to be selectively removable from and connectable to the hub and the seat assembly is usable as a child seat when removed from the frame, wherein the seat moves in a swinging direction and the orientation of the seat relative to the swinging direction can be selectively adjusted between a forward facing direction and a side facing direction, and wherein the hub has a pair of bosses protruding from opposed sides thereof, the hanger configured to mount to and hang the seat assembly from the bosses.

6. A child swing according to claim 5, wherein the hanger has a pair of upwardly open pockets positioned to respectively catch on the bosses to hang the seat assembly from the hub.

7. A child swing according to claim 6, wherein the hanger has a latch with an actuator and a pair of latch legs, the latch biased to a latched position with each latch leg engaged with a respective one of the bosses, the actuator actuable to move the latch legs to a released position disengaged from the bosses.

8. A child swing comprising:

a frame having a base, a support extending up from the base, and a hub carried by the support above the base; and a seat assembly having a swing arm with a seat carried at a lower end and a hanger at an upper end coupled to the hub, wherein the hanger is configured to be selectively removable from and connectable to the hub and the seat assembly is usable as a child seat when removed from the frame, wherein the seat moves in a swinging direction and the orientation of the seat relative to the swinging direction can be selectively adjusted between a forward facing direction and a side facing direction, and wherein the hub defines a swing axis about which the swing arm pivots, the swing axis oriented aligned with the support so that the seat moves in a swinging direction tangent to the support.

9. A child comprising:

a frame having a base, a support extending up from the base, and a hub carried by the support above the base; and a seat assembly having a swing arm with a seat carried at a lower end and a hanger at an upper end coupled to the hub, wherein the hanger is configured to be selectively removable from and connectable to the hub and the seat assembly is usable as a child seat when removed from the frame, wherein the seat moves in a swinging direction and the orientation of the seat relative to the swinging direction can be selectively adjusted between a forward facing direction and a side facing direction, and wherein the seat has a seat frame and a pair of spaced apart legs, wherein the legs are curved to define a rocker surface whereby the legs can support the seat above a support surface and are configured to allow the seat to rock thereon or wherein the legs are resilient and can support the seat above the support surface and are configured to allow the seat to bounce thereon, or both.

10. A child swing comprising:

a frame having a base, a support extending up from the base, and a hub supported by the support above the base; and a seat assembly having a swing arm with an upper end coupled to the hub and a seat carried by a lower end of the swing arm, the hub and seat assembly configured so that the seat moves in a swinging direction, and wherein the orientation of the seat relative to the swinging direction can be adjusted among a plurality of different seat facing orientations including one swinging direction orientation and a side facing orientation, wherein the seat assembly is configured to be detachable from and connectable to the hub and is usable as a child seat separate from the frame, and wherein the hub has a rotatable part that can be rotated about a generally vertical axis, whereby the seat assembly and rotatable part rotate in concert when the seat assembly is reoriented.

11. A child swing according to claim 10, wherein the rotatable part is concentrically connected to a non-rotatable part, the seat assembly connected to the rotatable part, the rotatable part having a lock mechanism configured to releasably lock the seat assembly in any selected one of the plurality of seat facing orientations.

12. A child swing according to claim 11, wherein the rotatable part has a release element connected to the lock mechanism biased to a locked position preventing rotation of the rotatable part and movable to an unlocked position permitting rotation of the rotatable part.

13. A child swing according to claim 10, wherein the rotatable part is connected to the seat assembly and rotatable about a generally vertical axis, the rotatable part having a lock mechanism with a protrusion configured to seat in any selected one of a plurality of notches in the hub, each notch coinciding with one of the plurality of seat facing orientations.

14. A child swing according to claim 13, wherein the protrusion is coupled to a push button release element that projects from the rotatable part of the hub.

15. A child swing according to claim 10, wherein the plurality of seat facing orientations includes the side facing orientation with the seat facing away from the support and includes the one swinging direction orientation oriented 90° from the side facing orientation in one direction and an opposite swinging direction orientation oriented 90° in the opposite direction from the side facing orientation.

16. A child swing according to claim 10, wherein the seat has a seat frame and a pair of spaced apart legs, wherein the legs are curved to define a rocker surface whereby the legs can support the seat above a support surface and are configured to allow the seat to rock thereon or wherein the legs are resilient and can support the seat above the support surface and are configured to allow the seat to bounce thereon, or both.

17. A child swing comprising:

a frame having a base, a support extending up from the base, and a hub supported by the support above the base; and a seat assembly having a swing arm with an upper end coupled to the hub and a seat carried by a lower end of the swing arm, the hub and seat assembly configured so that the seat moves in a swinging direction, wherein the orientation of the seat relative to the swinging direction can be adjusted among a plurality of different seat facing orientations including one swinging direction orientation and a side facing orientation, wherein the seat assembly is configured to be detachable from and connectable to the hub and is usable as a child seat separate from the frame, and wherein the hub defines a swing axis about which the swing arm pivots, the swing axis oriented aligned with the support so that a plane of the swinging direction is tangent to the support.

18. A child swing according to claim 17, wherein the plurality of seat facing orientations includes an opposite swinging direction orientation oriented 180° from the one swinging direction orientation and wherein the side facing orientation faces away from the support.

19. A child swing comprising:

a frame having a base, a support extending up from the base, and a hub carried by the support above the base; and a seat assembly having a swing arm with a seat carried at a lower end of the swing arm and a hanger at an upper end of the swing arm, the hanger being detachably coupled to the hub, wherein the hanger is configured to be selectively removable from and connectable to the hub and the seat assembly including the swing arm and seat is usable as a child seat when removed from the frame, and wherein the seat moves in a swinging direction relative to the frame and the orientation of the seat assembly including the seat and the swing arm relative to the swinging direction can be selectively adjusted between a forward facing direction and a side facing direction.

20. A child swing according to claim 19, wherein the hub defines the swinging direction and the orientation of the seat assembly is selectively adjusted by changing the orientation of the hanger relative to the hub.

* * * * *